United States Patent [19]

Boone, Jr. et al.

[11] Patent Number: 4,979,520

[45] Date of Patent: Dec. 25, 1990

[54] PEDIATRIC DEVICE FOR IMMOBILIZING INJURED INFANT UTILIZING A STANDARD SIZE BACKBOARD

[76] Inventors: Robert L. Boone, Jr., 6239 Beaumont Ave.; Debra J. Zielonka, 2603 Fair Oak St., both of Orlando, Fla. 32808

[21] Appl. No.: 333,466

[22] Filed: Apr. 5, 1989

Related U.S. Application Data

[63] Continuation-in-part of Ser. No. 135,931, Dec. 21, 1987, abandoned.

[51] Int. Cl.[5] ..... A61G 1/00

[52] U.S. Cl. ..... 128/870; 128/876; 5/82 R

[58] Field of Search ..... 128/870, 871, 869, 874, 128/875; 5/82, 81, 89

[56] References Cited

U.S. PATENT DOCUMENTS

| | | | |
|---|---|---|---|
| 2,410,181 | 10/1946 | Peters | 5/82 |
| 3,469,268 | 9/1969 | Phillips | 128/820 |
| 3,889,668 | 6/1975 | Ochs | 128/870 |
| 4,127,120 | 11/1978 | Applegate | 128/820 |
| 4,182,322 | 1/1980 | Miller | 128/869 |
| 4,211,218 | 7/1980 | Kendrick | 128/870 |
| 4,259,950 | 4/1981 | Klippel | 128/870 |
| 4,400,820 | 8/1963 | O'Dell | 128/869 |
| 4,515,155 | 5/1985 | Wagemann | 128/874 |
| 4,571,757 | 2/1986 | Zolecki | 128/869 |
| 4,589,407 | 5/1986 | Koledin | 128/869 |
| 4,593,788 | 6/1986 | Miller | 128/869 |
| 4,594,999 | 6/1986 | Nesbitt | 128/869 |
| 4,601,075 | 7/1986 | Smith | 128/870 |
| 4,612,678 | 9/1986 | Fitsch | 5/82 R |
| 4,655,206 | 4/1987 | Moody | 128/870 |
| 4,665,908 | 5/1987 | Calkin | 128/870 |

*Primary Examiner*—Mickey Yu
*Assistant Examiner*—Michael Brown
*Attorney, Agent, or Firm*—Julian C. Renfro

[57] ABSTRACT

A restraint system for enabling a badly injured infant or small child to be immobilized on an adult size backboard, our device has a spinal immobilizer to be placed against the spinal portion of the injured infant, and held tightly in place by securing elements passing around the chest and abdominal portions of the injured infant. Our spinal immobilizer is radiotransparent and is constructed to offer considerable resistance to bending about its longitudinal axis, but permitting a degree of wrap around the torso of the injured infant. In one embodiment a collar member is affixed to an upper part of the immobilizer, and the securing elements of the immobilizer involve a pair of chest straps and a pair of abdominal straps. Fastening elements are located on the free end of each chest strap and abdominal strap, such that the respective pairs of straps can be properly fastened together tightly around the chest and abdominal portions of the injured infant. In the one embodiment of our invention, the rear side of the collar member, the side away from the neck of the injured infant, is covered to a substantial extent by fastening elements, such that the collar member can be tightly yet removably fastened to an adult size backboard. Another embodiment of our invention can involve the use of at least one strap passing through handholes of the backboard, by the use of which, the spinal immobilizer can be removably secured to the backboard.

23 Claims, 4 Drawing Sheets

FIG 5
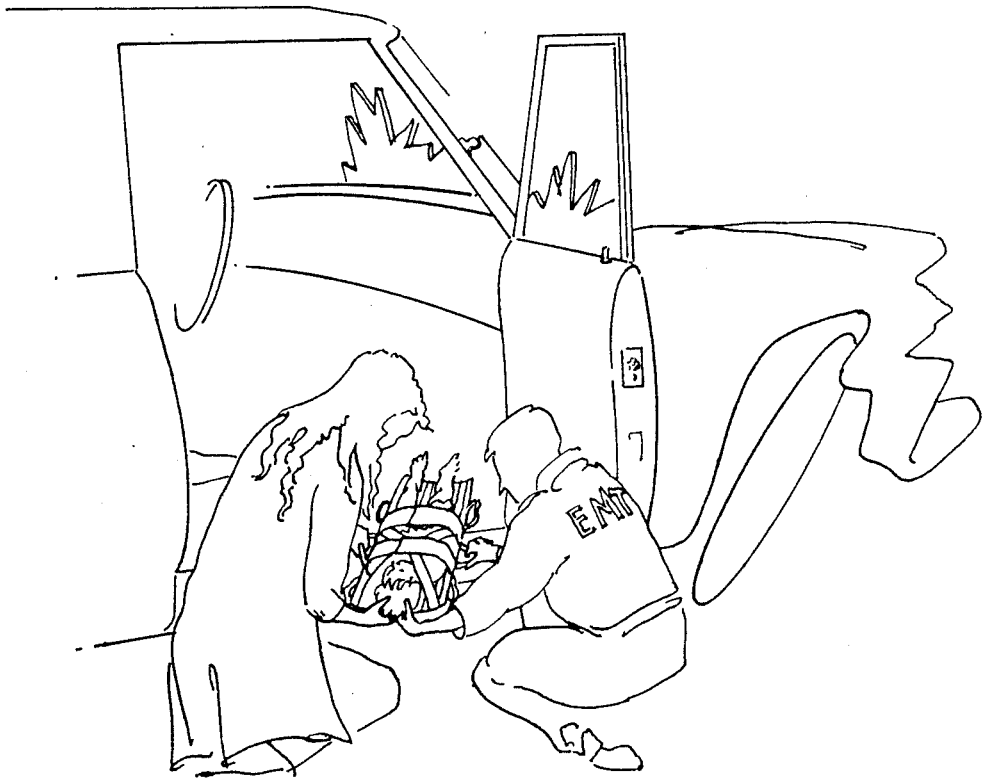
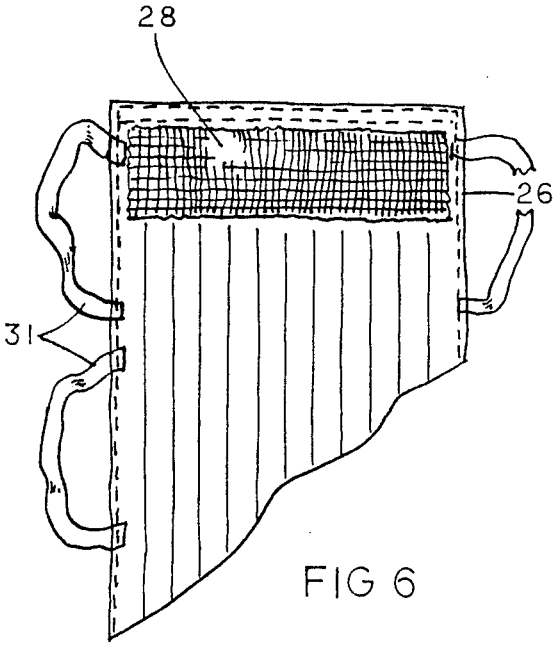
FIG 6
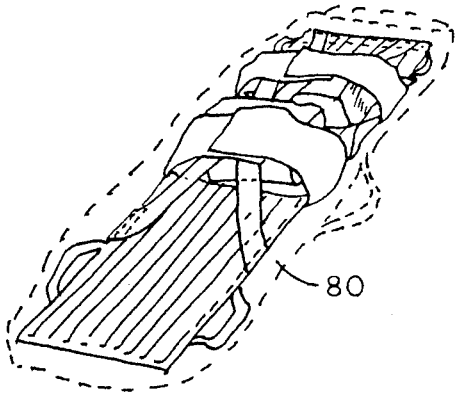
FIG 7

PEDIATRIC DEVICE FOR IMMOBILIZING INJURED INFANT UTILIZING A STANDARD SIZE BACKBOARD

RELATIONSHIP TO PREVIOUS INVENTION

This is a continuation-in-part of our patent application entitled "Pediatric Brace for Immobilizing Injured Infant on Standard Size Backboard," Ser. No. 135,931, filed Dec. 21, 1987, which application was abandoned with the filing of this patent application.

BACKGROUND OF THE INVENTION

The present invention pertains to a type of emergency medical device or harness for use with an injured infant or small child, and its combination with a solid support, such as a backboard. More particularly, this invention pertains to a novel spinal immobilizer for an infant or a small child, and the novel means whereby such spinal immobilizer may be conveniently and effectively used with an adult size backboard.

In recent years, pediatric trauma has been receiving widespread attention, inasmuch as pediatric trauma is one of the leading causes of infant death. By pediatric trauma we mean to include not only automobile accident victims, but also infants and young children injured on bicycles, falls from trees, and from a wide variety of sporting accidents.

For these reasons, a considerable amount of current attention has been directed to the field of emergency medical care. This emphasis, at least in part, has arisen by reason of increased awareness that the chances for the successful recovery of a victim of an injury or ailment may be enhanced significantly through substantial improvement in the methods employed and the equipment utilized in retrieving the victim from an emergency situation, and transporting him or her to an appropriate medical facility. Such emphasis has led to the establishment of intensive training throughout the country of Emergency Medical Technicians (EMTs) and paramedics. At the same time, considerable effort has been devoted to the improvement and the expansion of the variety of kinds of equipment carried in ambulances, rescue vehicles and other emergency units.

One area of particular concern to us has been the removal and transportation of an accident victim who may have been subjected to severe physical forces effective against his or her back, neck and head. Because both motor and response functions normally associated by the layman with the brain actually involve the entire spinal column, it is possible that even comparatively slight physical damage to any portion of the spinal column may result in severe permanent impairment, or even death in the event of high cervical spine trauma. Moreover, it is all too easy, in removing and transporting a victim, to aggravate an initially simple and nonserious area of physical injury in such a way that permanent disability or death is inadvertently caused to occur.

One especially difficult removal problem often occurs in the case of vehicle accidents. A victim may be wedged behind portions of the vehicle that are bent and distorted, making it exceedingly difficult for the EMTs or paramedics to gain ready access. In that case, an attempt is usually made to insert a special device to provide support behind the back of the seated victim. Such a device is a short backboard approximately the size of the victim's upper torso, in terms of length and width. Then, the person or persons aiding the victim must attempt to weave long flexible straps in and around the short backboard and the victim even though often working in extremely tight quarters.

Thus it has been customary, whenever at all possible, to immobilize the entire spinal column prior to permitting or effecting the slightest movement of the upper torso, neck and head of victims who remain in a sitting position in their vehicle. To that end, one EMT usually gently but firmly immobilizes the head of the victim while the other attendant affixes a cervical collar, and then inserts the appropriate support behind or beneath the victim's backside. The previously mentioned long flexible straps, having buckles at one end, are then woven through slots provided along the side edges of the backboard, and criss-crossed behind the board and over the front of the upper torso of the victim, as well as around his or her upper thighs, in a manner to bind the victim immovably to the spinal support device. A separate harness assembly may be placed over the point of the chin and around the forehead and then tightly secured, now usually by means of Velcro fasteners, to an upper portion of the support device. When such an arrangement of straps and head harness is properly applied, the victim may then be removed and transported with greatly minimized risk of further injury. Analogous strapping approaches frequently are utilized in connection with the transport of a victim by means of a stretcher.

Injured infants and small children present an unusual problem in that the adult size backboards are much too large to be utilized with small persons, and most emergency vehicles do not have enough space to accommodate infant size backboards.

Unfortunately, the aforementioned short backboards used in connection with seated auto accident victims are not of the proper configuration to be used with badly injured infants and small children. Accordingly, we were motivated to design components enabling an emergency vehicle carrying only adult size backboards, to use such full size backboards in the safe and effective restraint of infants and small children that have been seriously injured.

We are aware of other devices in the general nature of our device, such as the Kendrick U.S. Pat. No. 4,211,218 entitled "Spinal Restraint Device."

As that patentee explains, a spinal restraint device is provided in the form of a body member having a head support portion, a neck support portion, and a back support portion. The back support portion and the neck support portion have a body wrap-around arm portion extending laterally from each of its sides. The body member has a front sheet-like layer of flexible material, a middle sheet-like layer of flexible material, and a rear sheet-like layer of flexible material. Laterally spaced longitudinal rows of stitching secure the front, middle, and rear sheet-like layers of flexible material together to form a plurality of longitudinal sleeves between the front sheet-like layer of flexible material and the middle sheet-like layer of flexible material. The longitudinal sleeves extend substantially across the entire width of the body member. Stiffener members are located within the longitudinal sleeves. The spinal restraint device has a pair of leg loop straps attached to the rear surface of the back support portion and a hoisting loop attached to the rear surface of the head support portion.

The Kendrick device, however, does not meet the need for a pediatric restraint device of the type indicated, for its use is limited to dealing with a victim remaining in a seated position.

We are also aware of a pediatric immobilization system advertised in the Fall 1987 Catalog bearing the title "CritiCare, " published by a division of Clark Surgical Corporation. On Page 35 of that catalog, a Pediatric Immobilization System bearing the tradename "Pedi-BacPac" is advertised, which is designed to slide over an existing adult backboard and instantly convert it to a pediatric immobilization system. Although such device has certain advantageous features for the immobilization of a pediatric trauma patient, it is not, by the clear wording of the advertisement, intended for infant immobilization. In addition, the Pedi-BacPac could not be taken into a wrecked vehicle to immobilize a badly injured child, to prevent it from flailing its limbs, for the Pedi-BacPac provides by itself no spinal support, and the cramped conditions of a wrecked vehicle may well not afford sufficient space for the accommodation of a full size backboard. Also, the Pedi-BacPac utilizes certain metallic components, which would not permit immediate x-ray of the patient, and that device also would prevent the application of CPR to a child needing same, and it further would prevent the application of a M.A.S.T. suit to the child restrained in the Pedi-Bac-Pac.

Another prior art patent of which we are aware is the Peters U.S. Pat. No. 2,410,181, entitled "Stretcher," which issued on Oct. 29, 1946. Peters describes his device as being an elongate frame made of metal tubes enclosed in canvas. It is designed for carrying and moving people without regard to spinal injury, and has float members 22 disposed along the sides of the device. Peters uses flexible bands extending transversely across the stretcher and positioned to substantially encircle the portion of the body below the hips and above the knees. It can readily be used in place of an ordinary stretcher.

Importantly, Peters uses no distinct collar member, as used in one of the embodiments of this invention, and his closest approach to a collar member is the section of the canvas between parallel bands 4, which is seen to involve the front sheet-like layer of material referred to as canvas that happens to be under the patient's neck.

Head restraint pads utilized in the Peters patent are actually nothing more than parallel bands of flat material that are sewn onto the front near the head portion. They only act as a means to allow flexible strap 17 or any similar means to pass between the upper portions of bands. Unfortunately, the arrangement taught by Peters permits a highly undesirable side to side movement of the injured person's head, so his stretcher configuration entirely fails to properly immobilize the head of the injured person, even when the person may have a suspected cervical injury.

As will be seen hereinafter, the spinal immoblizer in accordance with the instant invention offers considerable resistance to bending to help prevent further spinal injury. The instant device is designed to be used with an adult size backboard and stretcher for maximum stabilization in the event the patient may have suffered spinal cord injuries. The distinct collar member in accordance with one embodiment of this invention is the rear portion of the spinal immobilizer near the head end, which allows the immobilizer to be attached to an intermediate member, or to the adult size backboard by hook and loop Velcro, or by any other suitable attachment means.

We describe hereinafter that the collar member used in accordance with one embodiment of our pediatric brace is significant in that it advantageously utilizes an attachment means for readily and easily securing our novel device directly to an adult size backboard, or to an intermediate piece.

SUMMARY OF THE INVENTION

With regard to the details of our device, one of it s significant aspects is the body support or spinal support that it provides, containing in its interior, a number of slats of wood or the like, affording ample resistance to undesired motion of the spinal portion of the victim, but nevertheless permitting its ready use in connection with infant or child accident victims. Our novel body support or spinal support is of sufficiently small size as to permit it to be applied to a small patient on the floorboard of an automobile, for example, yet it is large enough to immobilize children up to a weight of approximately 60 pounds.

Our body support or spinal immobilizer utilizes wide chest straps and abdominal straps, but in addition may use two pairs of diagonal straps, that form an "X" configuration across the young patient. These latter straps are fastened together, preferably by the use of Velcro, before the wide chest straps and abdominal straps are fastened together, also by the use of Velcro.

Advantageously, our novel body support or spinal support readily permits one arm of the patient to be removed from the straps of the device, so that, for example, intravenous therapy can be administered, or blood pressure measured.

Now in more detail, it is to be seen that our restraint system for enabling a badly injured infant or small child to be immobilized on an adult size backboard comprises a spinal immobilizer to be placed against the spinal portion of the injured infant, and held tightly in place by securing means passing around the chest and abdominal portions of the injured infant. Our spinal immobilizer is radiotransparent and is constituted by front and rear sheet-like layers of flexible material, between which are secured a plurality of elongate stiffener members. Our novel spinal immobilizer permits a degree of wrap around the torso of the injured infant, but with very little bending of the stiffener members being permitted.

One embodiment of our invention involves a distinct collar member affixed to the uppermost part of the spinal immobilizer, with the front side of the collar member being disposed against the neck and/or shoulder of the injured infant or small child at the time he or she is immobilized. Quite importantly, the rear side of the collar member utilizes fastening means or attachment means, such as loop type velcro. In this way it is a relatively simple matter to removably affix our novel spinal immobilizer securely to a wide strip of hook type Velcro mounted on or secured to an adult size backboard. This highly advantageous arrangement makes it unnecessary for an emergency medical vehicle to carry child size backboards.

The front side of the collar member is able to be contacted by the rear portions of the head and neck of the injured infant, and the rear side of the collar member is covered to a substantial extent by attachment means, such that said collar member can be rapidly and tightly, yet removably attached to an adult size backboard.

The aforementioned securing means preferably involves a pair of chest straps and a pair of abdominal straps, although it is possible to use instead, a single pair of extra wide straps to wrap tightly around the chest and abdomen of the injured infant or young child. One member of the chest straps is affixed to a first upper side of the spinal immobilizer, and the other member of the chest straps is affixed to the opposite upper side of the spinal immobilizer. Fastening means are located on the free end of each chest strap, such that the pair of chest straps can be fastened tightly around the chest portion of the injured infant. One member of the abdominal straps is affixed to a first middle portion of the spinal immobilizer, and the other member of the abdominal straps is affixed to the opposite middle portion of the spinal immobilizer. Fastening means are located on the free end of each abdominal strap, such that the pair of abdominal straps can be fastened tightly around the abdomen portion of the injured infant. Velcro is preferred for the fastening means, but is not mandatory.

Advantageously, the rear side of the collar member, the side away from the neck of the injured infant, is covered to a substantial extent by Velcro of a first type, so that the collar member can be rapidly and tightly fastened to an adult size backboard upon which Velcro of a second type has been affixed.

We find it preferable, however, to utilize a novel intermediate member or base piece, described at some length hereinafter, between our novel spinal immobilizer and the adult size backboard, for the intermediate member or base piece is configured so as to simplify not only the mounting of the spinal immobilizer, but also the mounting of the head restraint means. The head restraint means involves a pair of pads to be utilized on the sides of the head of the injured infant or small child. The preferred form of our device not only includes the novel intermediate member, but also includes diagonal strap means that are tightly enclosed about the injured infant or young child, before the chest straps and abdominal straps are fastened about the infant.

At the present time there are several ways to immobilize a patient suspected of having spinal injuries. These devices work well on adult size patients, but they generally do not provide an adequate means of immobilizing a child size patient because of their construction and size. Our device has been measured and designed primarily for use on infants and small children.

The first concern of the EMT is to apply and maintain manual cervical support until the patient is completely immobilized in the device. This is done by placing the palms of the EMT's hands to the corresponding sides of the patient's head and the fingers spread to encompass the base of the skull and the upper cervical spine region. While one EMT maintains cervical spine support, the patient is placed onto a long spine board with the head being centered on the base piece between the Velcro. One head restraint pad is then firmly placed alongside the patient's head with the bottom portion resting on the patient's shoulder. The second head restraint pad is then placed in the same manner.

Before releasing manual support, head and chin straps must be applied securely. All components must be firmly placed against the patient's head to minimize lateral and flexion type movement. At this time, manual support can be released and the patient transported to the hospital.

It is therefore to be seen that a primary object of our invention is to pro vide a novel spinal immobilizer for an injured infant or small child, that is of low to modest cost, and which may be safely and effectively used in connection with a backboard of adult size.

Another object of the present invention is to provide a new and improved emergency medical immobilizer that can be readily applied to a struggling infant, to safely yet effectively restrain him, and then to be able to removably yet firmly affix the immobilizer to a conventional adult size backboard, so as to prevent aggravation of an initial spinal injury.

Still another object of the present invention i s to provide a new and improved emergency medical harness or immobilizer which is capable of being applied to a struggling infant and then removably affixed to an adult size backboard or other support, while an attendant may be working in an extremely confined space.

A further object of the present invention is to provide a new and improved emergency medical harness or immobilizer constructed of largely non-absorptive material, that may be utilized in association with a variety of different victim-transport devices.

A still further object of this invention is to provide a device usable in many different EMS situations, such as seizures, auto/pedestrian, auto/bike, or falls from playground equipment, with our novel device not only aiding restraint of the patient, but also effectively preventing further injury during transport.

A yet still further object of our invention is to provide an infant immobilizer readily affixed to a conventional adult size backboard, without in any way impairing the further use of the backboard with adults, with our infant immobilizer being in full compliance with certain state laws requiring proper restraint of young children being transported in a vehicle.

These and other objects, features and advantages of our invention will be more apparent as the description proceeds.

BRIEF DESCRIPTION OF THE DRAWINGS

FIG. 5 is a view showing haw a pair of EMT's might be going about immobilizing a badly injured infant prior to removing him from a confined portion of a wrecked vehicle;

FIG. 6 is a view to an enlarged scale of the backside of the novel collar member utilized with a first principal embodiment of our infant immobilizer, revealing the placement of effective fastening means such as Velcro thereon;

FIG. 7 is a view revealing the manner in which our novel spinal immobilizer may be compacted prior to it being placed in a carrying case of relatively small size;

DETAILED DESCRIPTION

Figure 1:
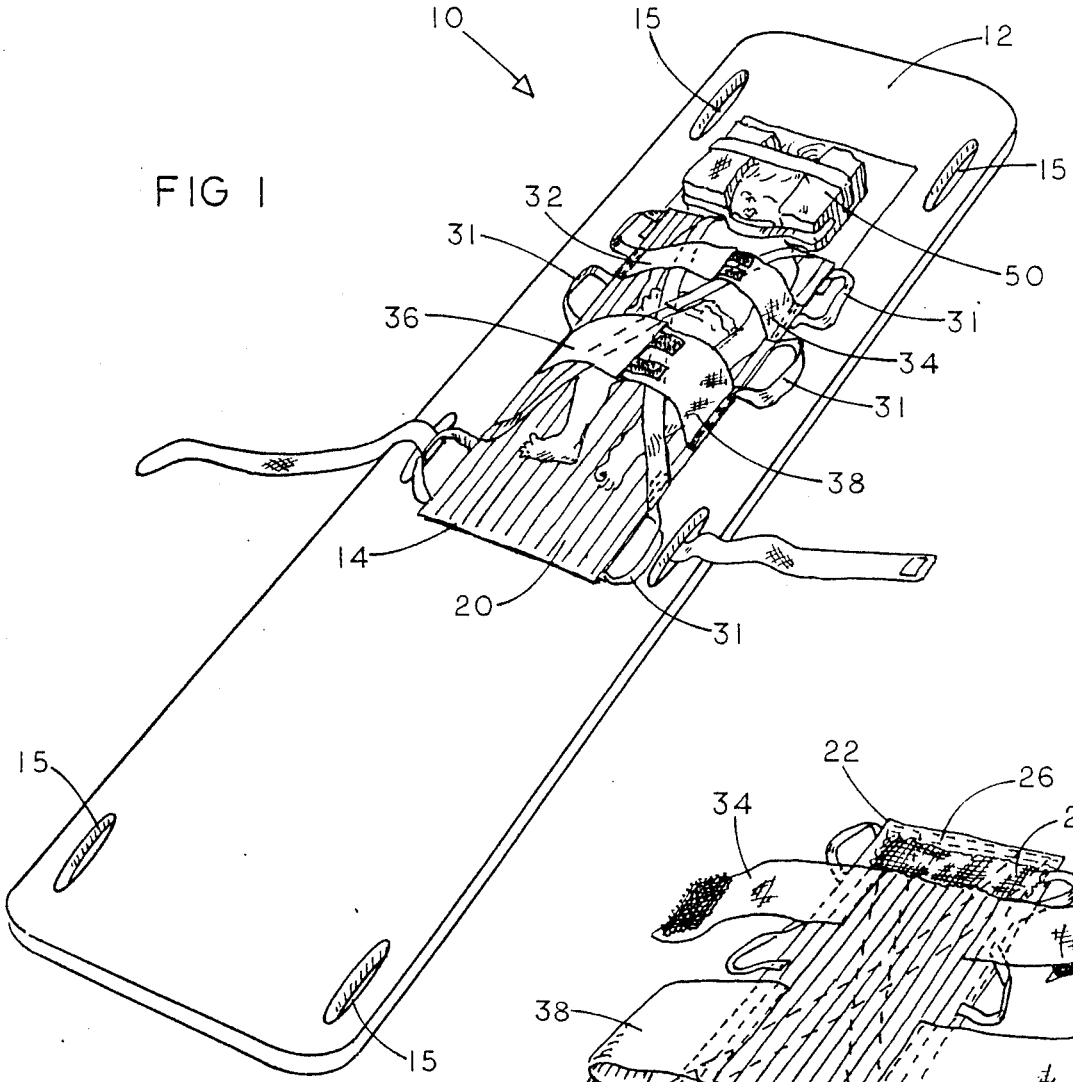
FIG. 1 is an overall perspective view showing how in accordance with our novel infant immobilizer, an injured infant or small child may be effectively and safely immobilized on an adult size backboard, without compromising the subsequent use of the backboard with an injured adult.

As shown in FIG. 1, our novel restraint system 10 for enabling a badly injured infant or small child to be immobilized on an adult size backboard 12 comprises a spinal immobilizer 14 that is to be removably secured to the backboard, without in any way compromising the future use of that backboard with an injured adult. The backboard i s equipped with a plurality of conventional handholes 15, which simplify the EMT's or other emergency personnel carrying the backboard.

Our novel spinal immobilizer 14 is to be placed against the spinal portion of the injured infant or young child, and held tightly in place by securing means passing around the chest and abdominal portions of the injured infant. Our spinal immobilizer 14 is radiotransparent and is constituted by front and rear sheet-like layers of flexible material, between which are secured suitable stiffener means. Although a single stiffener member could be used, we typically utilize a plurality of elongate stiffener members as the stiffener means.

Figure 1A:
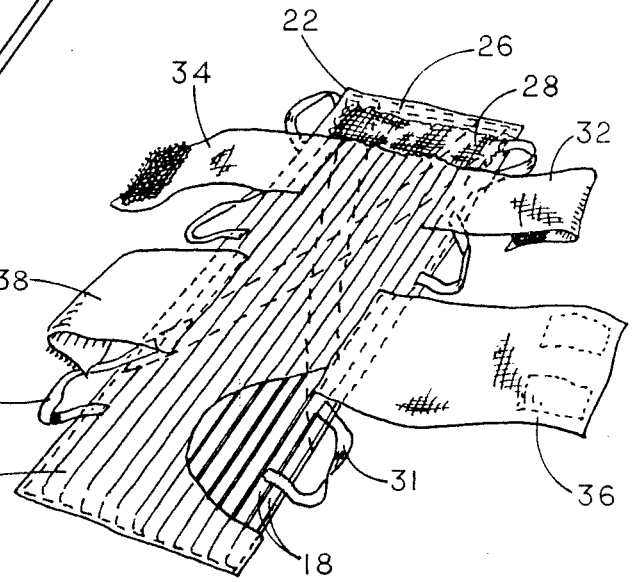
FIG. 1A is a view showing the rear side of our novel spinal immobilizer, revealing the collar equipped with fastening means, preferably loop type Velcro, so that the spinal immobilizer may be removably secured to an adult size backboard.

The type of construction we prefer is further shown in FIG. 1A, wherein the rear side of our spinal immobilizer is revealed. It will be noted from one portion of this figure that a rear sheet-like layer 16 forms the outermost portion of our spinal immobilizer, located adjacent which are the plurality of elongate stiffener members 18. In FIG. 1 , the front sheet-like layer 20 is shown, against which the injured infant resides. The front sheet-like layer 20 is stitched or otherwise secured around its periphery to the rear sheet-like layer 16, thus to encapsulate the elongate stiffener members 18 inside the immobilizer. Conventional stitching between the stiffener members assures their being retained in the desired individual or spaced relationship. Other details concerning the construction of our preferred spinal immobilizer will be discussed to a greater extent hereinafter.

As will be understood, our spinal immobilizer 14 permits a degree of wrap around the torso of the injured infant, but with very little bending of the stiffener members 18 being involved or permitted. This prevents additional spinal injury to the injured infant, which of course is most important, because any derangement of the spinal column with its accompanying neuro-vascular components can have catastrophic results on the well being of the victim.

Figure 2A:
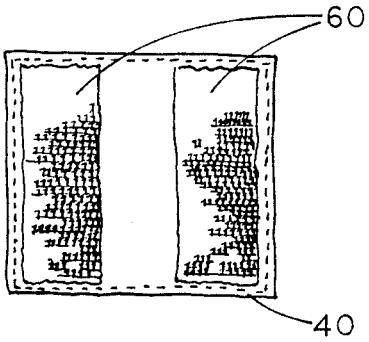
FIG. 2A is a view of one side of our novel intermediate member that may be used on the adult size backboard in order to provide effective mounting means for the pair of head immobilizer pads shown in FIG. 3, as well as to enable our spinal immobilizer to be readily and removably secured to the adult size backboard.
Figure 2B:
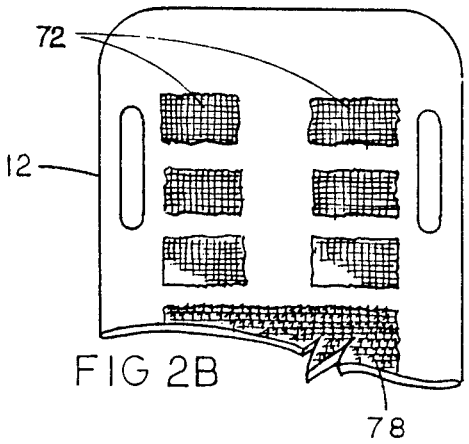
FIG. 2B is a fragmentary view of the upper end of an adult size backboard, revealing the utilization in accordance with this invention of fastening means or first mating attachment means such as Velcro thereon, so that either the intermediate member of FIG. 2A can be removably secured to the backboard, or else the collar of our spinal immobilizer removably secured directly to the adjust size backboard.
Figure 4:
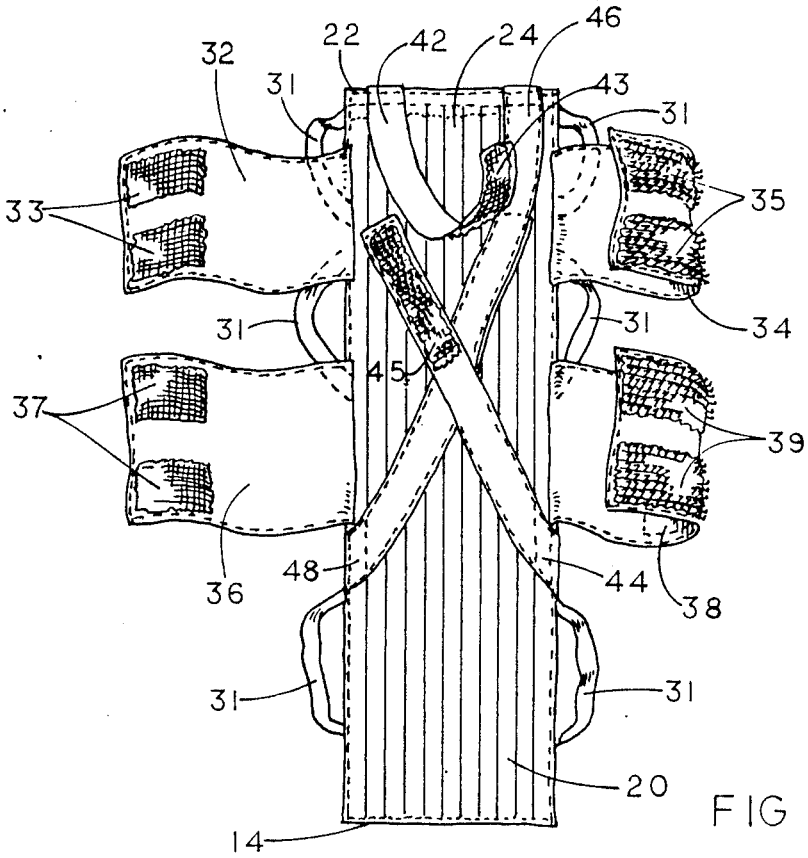
FIG. 4 is a plan view of a preferred embodiment of our novel spinal immobilizer, revealing that comparatively narrow diagonal straps are preferably secured around the injured infant prior to the securing of the wide chest straps and the wide abdominal straps around the infant.

In this first embodiment of our invention, a distinct collar member 22 is affixed to the uppermost part of the spinal immobilizer, as will be seen in FIGS. 1A and 4, with the front side 24 of the collar member being disposed against the neck and/or shoulder of the injured infant or small child at the time he or she is immobilized. Quite importantly, the rear side 26 of the collar member, as best seen in FIGS. 1A and 6, utilizes fastening means or attachment means 28, such as loop type velcro. We may also refer to this as a second attachment means. In this way it is a relatively simple matter to removably affix our novel spinal immobilizer securely to a wide strip 78 of hook type Velcro that is shown in FIG. 2B as being mounted on or secured to the adult size backboard 12, located near several pads 72 of loop type Velcro. This highly advantageous arrangement makes it unnecessary for an emergency medical vehicle to carry child size backboards, while at the same time not in any way compromising the future use of the backboard with an injured adult.

The front side 24 of the collar member 22 is able to be contacted by the rear portions of the head and neck of the injured infant, and the rear side 26 of the collar member is covered to a substantial extent by the second mating attachment means, such that the collar member can be rapidly and tightly attached to an adult size backboard. This attachment means typically takes the form of loop type Velcro, which is readily attachable to hook type Velcro utilized on the adult size backboard, or else used on an intermediate member about to be described.

Quite obviously we are not to be restricted to this particular holding means nor to any particular type of Velcro array.

Figure 3:
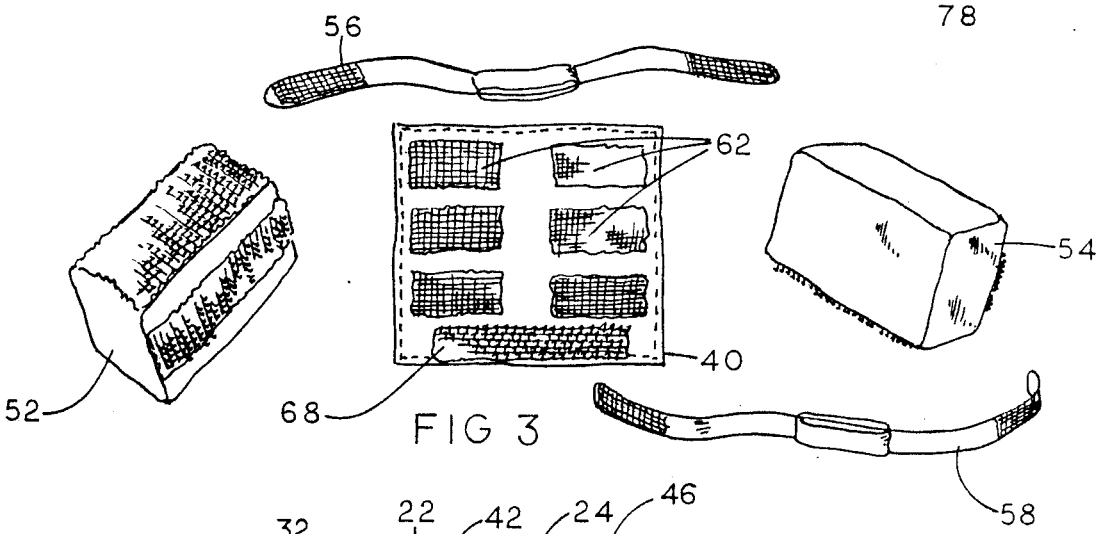
FIG. 3 is a view revealing, in a generally exploded manner, certain important components of our invention, with the central portion of this view depicting the opposite side of the intermediate member of FIG. 2A, and with the outer portions of this view illustrating the pair of head restraint pads, as well as the head restraint and the chin restraint straps we utilize for preventing undesired head movement of the injured infant.

In accordance with this first embodiment of our invention under consideration, a novel intermediate member or base piece 40 is utilized between the backboard and the immobilizer 14. One side of the intermediate member, the rear side, is illustrated in FIG. 2A, and the other side of this member, the front side, is illustrated in FIG. 3. The intermediate member is described at further length hereinafter, and this member is to be regarded as one of the significant aspects of our invention. The use of our intermediate member or base piece between our novel spinal immobilizer and the adult size backboard simplifies the mounting of the head restraint means 50, involving pads 52 and 54, on each side of the head of the injured infant or small child. By tightly securing the pads 52 and 54 in the correct locations, lateral or side to side movements of the head of the injured infant are effectively prevented. We preferably utilize stiffener means in the interior of the intermediate member or base piece, which serves to prevent any type of bending or twisting motion thereof.

Returning to FIG. 1, it will be seen that the securing means or restraint means associated with our novel spinal immobilizer 14 involves at least one pair of comparatively wide straps able to be fastened securely around the torso of the injured infant, to secure him tightly to the spinal immobilizer. We prefer, however, to use separate pairs of chest straps and abdominal straps, and in addition, we may utilize a pair of diagonally arranged straps as well, which extend across the chest and abdomen of the injured infant, as hereinafter described. Our spinal immobilizer 14 also preferably utilizes a plurality of securely attached handles 31, such as of webbed nylon strapping material, as depicted in FIG. 1.

As may be seen in FIG. 1 as well as in FIG. 4, one member of the chest straps, member 32, is affixed to a first upper side of the spinal immobilizer 14, and the other member of the chest straps, member 34, is affixed to the opposite upper side of the spinal immobilizer. As better seen in FIG. 4, fastening means 33 located on the free end of chest strap 32, and fastening means 35 located on the free end of chest strap 34 make it possible for the pair of chest straps to be fastened tightly around the chest portion of the injured infant or child. In the present instance, fastening means 33 can be of loop type Velcro, and fastening means 35 of hook type Velcro, but we obviously are not to be limited to this particular arrangement.

Continuing with FIGS. 1 and 4, member 36, hereinafter regarded as the one member of the abdominal straps, is affixed to a first middle portion of the spinal immobilizer 14, and the other member 38 of the abdominal straps is affixed to the opposite middle portion of the spinal immobilizer. Fastening means 37 is located on the free end of the one abdominal strap 36, and fastening means 39 is located on the free end of the other abdominal strap 38, such that the pair of abdominal straps can be fastened tightly around the abdomen portion or legs of the injured infant or child.

Although we are not limited to the use of Velcro, we prefer for the fastening means 33 and 37 to be of one type of Velcro, and the fastening means 35 and 39 of the other type of Velcro, to simplify the rapid securing of the injured infant in the spinal immobilizer.

There are instances in which the use of additional securing means on the spinal immobilizer 14 are highly desirable, so to that end we prefer the use of two pairs of diagonal straps, each equipped with appropriate fastening means. These diagonal straps are preferably to be fastened around the injured infant prior to the fastening of the chest straps and abdominal straps, with the diagonal straps being revealed in FIG. 1, but in greater detail in FIG. 4.

With reference to FIG. 4, it is to be seen that a first diagonal strap member 42 is affixed to the upper portion of the spinal immobilizer, typically in the vicinity of the collar member 22, with the free end of this portion of the strap being provided on its underside with fastening means 43, such as Velcro. The second diagonal strap member, member 44, is affixed on the opposite side of the spinal immobilizer member 14, typically at a location below the abdominal strap 38, with a suitable fastening means 45 being provided on its upper surface. When Velcro has been provided as fastening means 43, Velcro of the opposite type is provided as the fastening means 45 for diagonal strap member 44.

In a similar manner, one part or portion of the second diagonal strap 46 is secured on the opposite upper side of the spinal immobilizer 14, and as best shown in FIG. 4, the strap 46 is preferably stitched or otherwise secured on the upper right hand corner of the immobilizer as viewed in FIG. 4, being secured very close to the collar member 22.

The other part of the second diagonal strap, strap 48, is to be secured o n the middle left hand portion of the spinal immobilizer 14, with FIG. 4 revealing that this second strap is stitched or otherwise secured below the abdominal strap 36. One side of the free end of strap 46 is preferably equipped with Velcro, whereas the other side of the free end of strap 48 is equipped with Velcro of the opposite type, so that the two halves of this second diagonal strap can be securely fastened around the patient.

It is to be realized that the diagonal straps are useful in several regards, with one important aspect being the fact that in the event the chest straps 32 and 34 need to be loosened so as to free one arm of the patient in order that an intravenous injection may be given, or blood pressure measured, the two pairs of crossed diagonal straps continue to hold the patient securely to the spinal immobilizer 14. In addition, the diagonal straps serve to minimize undesirable sliding motion of the patient inside the restraint arrangement.

Returning to a consideration of the collar member 22, quite advantageously, the rear side 26 of the collar member, the side away from the neck of the injured infant, is covered to a substantial extent by a means 28, which may be Velcro of the loop type, as indicated in FIG. 6. We afterward refer to this as being Velcro of a first type. Because of this arrangement, the collar member can be tightly yet removably fastened to an adult size backboard upon which a strip of Velcro 78 of the hook type has been affixed. We prefer to use Velcro of the loop type on most locations on the backboard, however, for unlike hook type Velcro, loop type Velcro does not snag on blankets, pads, vehicle upholstery, human hair, and other items to be found on an emergency vehicle, to which the backboard might accidentally and undesirably become attached if hook type Velcro were extensively used thereon.

We preferably utilize the novel intermediate member 40, of the type depicted in FIG. 2A and FIG. 3, so as to facilitate the use of head restraint means 50, as mentioned in connection with FIG. 1. FIG. 3 reveals the head restraint means to utilize immobilizing head pads 52 and 54, which are to be disposed closely adjacent the head of the immobilized infant, which pads are held tightly in place against the sides of the injured infant's head by the use of straps 56 and 58. This is a very important feature or aspect of our invention, for by the proper utilization of the pads 52 and 54, the head of the injured infant or small child can be prevented from moving in a lateral or side to side manner during transport. Especially when a cervical injury is suspected, this feature is of critical importance, and it is quite significant to note that most prior art devices fail to provide this feature.

Returning to FIG. 2A, Velcro of one type is preferably used on a first side of the novel intermediate member 40 as the first fastening means 60, whereas Velcro of the opposite type is utilized in an appropriate pattern as the second fastening means 62 of the intermediate member, as depicted in FIG. 3. Inasmuch as we prefer as extensively as possible to use loop type Velcro on the adult size backboard, we typically use hook type Velcro as the first fastening means 60 on the backside of the intermediate member 40, as depicted in FIG. 2A.

With reference to FIG. 2B, which is a fragmentary view revealing the upper portion of an adult size backboard 12, we utilize fastening means 72 on this upper portion of the backboard, and as previously mentioned, we prefer to utilize several rectangles 72 of Velcro of the loop type firmly secured to the upper surface of the backboard. These rectangles constitutes the first mating attachment means and are of course provided as a means for mounting the head restraint pads 52 and 54 in optimum positions, upon which pads hook type Velcro is typically used. The only exception to the extensive use of loop type Velcro on the backboard i s the previously mentioned wide strip of hook type Velcro needed in order to receive the loop type Velcro we prefer to utilize on the rear side 26 of the collar 22 of the infant immobilizer. This wide strip 78 of hook type Velcro on the backboard is normally covered by a strap, or by a strip of loop type Velcro, to prevent snagging when the board is not in active use.

By using hook type Velcro as the first fastening means 60 on the novel intermediate member 40, it does not present the problem that would have been posed by the extensive use of hook type Velcro on the backboard, for as is obvious, the relatively small intermediate member 40 may normally be carried in a small package, in the general nature of a pillow case, so as to minimize the hook type Velcro used thereon snagging on any extraneous object. As previously mentioned, we preferably utilize stiffener means in the interior of the intermediate member or base piece, which serves to minimize if not eliminate any type of bending or twisting motion of the intermediate member.

The fastening means 62 on the second side of our novel intermediate member 40 is placed so as to form a suitable mounting means for the head pads 52 and 54, both of which utilize Velcro on two separate longitudinal surfaces, as revealed in FIG. 3. On pad 52 in FIG. 3 we indicate that we prefer to use hook type Velcro on the two surfaces, which surfaces are 90 degrees apart. Pad 54 is identical to pad 52, and in FIG. 3 pad 54 has been turned to reveal a smooth major surface that is to be placed in contact with the side of the injured victim's face.

With regard to the attachment of the loop type Velcro near the top of the backboard 12, we may use self-adhering Velcro strips or rectangles 72 that are stuck onto the adult size backboard, but in order to provide sufficient security against the strips pulling away, we may use several #6 wood screws, such as ½ inch long, in order to reinforce the attachment of the Velcro strips 72 to the backboard. As is obvious, we could also provide such additional security by stapling or otherwise firmly locating the Velcro strips to the backboard, so the particular attachment means used need not be critical. As is also obvious, a unitary piece of Velcro of the appropriate size and type may be utilized on the backboard instead of the separate pads, if for any reason such is preferred. Quite obviously the application of Velcro to an adult size backboard in no way prevents the future use of that backboard with injured adults.

In accordance with present day prior art techniques, there are several ways to immobilize a patient suspected of having spinal injuries. These devices work well on adult size patients, but they generally do not provide an adequate means of immobilizing a child size patient because of their construction and size. Our device has been measured and designed primarily for use on infants and small children.

The first concern of the EMT is to apply and maintain manual cervical support until the patient is completely immobilized in the device. This is done by placing the palms of the EMT's hands to the corresponding sides of the patient's head and the fingers spread to encompass the base of the skull and the upper cervical spine region. While one EMT maintains cervical spine support, the patient is placed onto a long spine board (backboard) with the head being centered on the base piece between the Velcro. The smooth side of one of the head restraint pads is then firmly placed alongside the patient's face, with the end portion resting on the patient's shoulder, and one of the hook type Velcro portions of the pad in contact with the loop type Velcro pad on the intermediate member 40, or on the backboard if the intermediate member is not used. The second head restraint pad is then placed in the same manner, but on the opposite side of the patient's face.

Before releasing manual support, the head and chin straps 56 and 58 must be applied securely. All components must be firmly placed against the patient's head to minimize lateral and flexion type movement. This being accomplished, manual support can be released and the patient transported to the hospital. It is important to note that the previously mentioned Peters U.S. Pat. No. 2,410,181 utterly fails to provide an arrangement effectively preventing lateral or side to side motion of the injured person's head during transport on his device.

It is also important to note that the fastening means on the second side of our novel intermediate member 40 include the use of a comparatively long, laterally disposed strip of hook type Velcro, this being strip 68, which is of a length corresponding to the length of the Velcro strip 28 utilized on the rear side 26 of the collar member 22 of our novel spinal immobilizing member; note FIG. 6. As previously made clear, we prefer to use loop type Velcro on the backside 26 of the collar 22, to prevent the collar of our infant immobilizer snagging on any part of the interior of the vehicle, for example.

As is obvious, the Velcro fastening means 62 are placed on the intermediate member 40 so as to readily receive one set of the comparatively long Velcro strips, preferably of hook type Velcro, that are used on the head pads 52 and 54, whereas the other long Velcro strips on the head pads receive the straps 56 and 58, which preferably use loop type Velcro. It can be seen in FIG. 1 that one of the latter straps is utilized in the vicinity of the injured infant's forehead, spanning across from one head pad to the other, whereas the other strap spans across the head pads in the vicinity of the injured infant's chin.

After the injured infant has been immobilized in our novel spinal immobilizer, he or she is then placed on the adult size backboard, with the loop type Velcro surface 28 on the back of the collar 22 being positioned so as to coincide with the laterally disposed hook type Velcro strip 78 utilized near the loop Velcro pads 72 on the upper end of the backboard, or if our novel intermediate member 40 is used, with the back of the collar 22 coinciding with the hook type Velcro strip 68 utilized across the bottom of the intermediate member 40. We prefer to place the Velcro or other such means for receiving the rear side 26 of the collar 22 near the upper end of the backboard, but we are not to be limited to this.

As can be readily appreciated, when our novel intermediate member 40 is used, it presents ample surfaces for the attachment of the head pads 52 and 54 in the most appropriate location for the particular patient, with the straps 56 and 58 thereafter being applied to contact the head pads so as to immobilize the infant's head against either lateral motion or forward motion as effectively, yet painlessly, as possible.

Nylon covered foam or the like is preferably used in the center of the straps 56 and 58, so as to provide as much comfort as possible for the patient.

After the injured infant or small child has been properly secured to our spinal immobilizer, the injured infant is then ready to be placed on a stretcher, with straps typically being used to hold the immobilized infant and the backboard in the stretcher. Therefore, it is not particularly consequential that this embodiment of our spinal immobilizer has a suitable fastening means such as Velcro in only a single location, the back of the collar member. This is true because after the backboard has been strapped into the stretcher, there is no way that even a struggling infant can free himself.

As revealed in FIG. 7, our novel pediatric brace or infant immobilizer may readily be folded into a compact configuration, that it may be fitted into a relatively small, conveniently carried case 80, indicated by dashed lines in this figure.

Figure 8B:
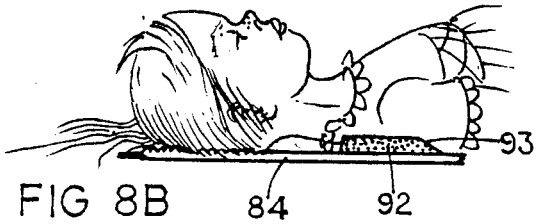
FIG. 8B is a fragmentary view to a larger scale, revealing the pad that we may place under the shoulders of a badly injured infant or small child.
Figure 8A:
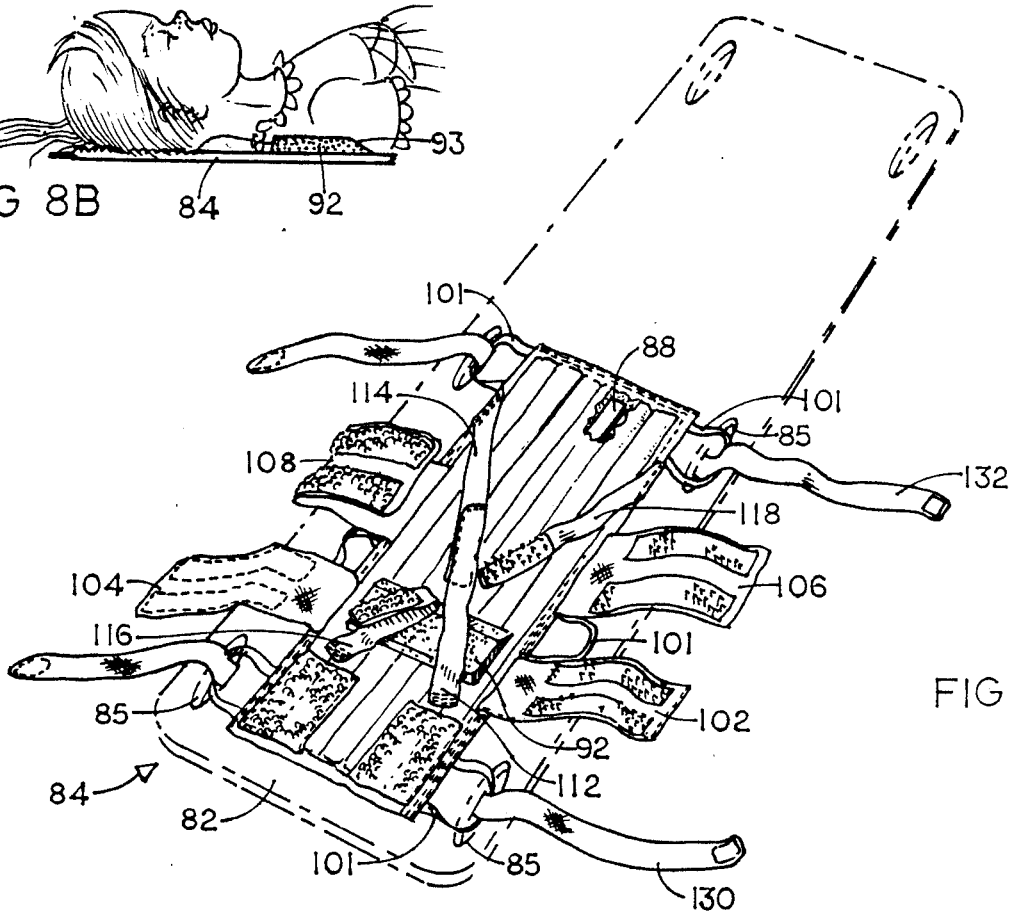
FIG. 8A is a perspective view of a second principal embodiment of our invention, in which no Velcro is utilized in securing our novel spinal immobilizer to an adult size backboard, with the spinal immobilizer instead being removably secured to the backboard by the use of suitable elongate straps extending through handholes on the backboard as well as through handles on the immobilizer.

Turning now to a second major embodiment of our invention, we have shown in FIG. 8A, a backboard 82 having a plurality of handholes or handholds 85 that may be regarded as conventional. Secured upon the adult size backboard 82 is a spinal immobilizer 84 secured to the backboard by the use of elongate straps 130 and 132 that extend through the handholes 85 of the backboard. It is to be understood that several of the significant details of the spinal immobilizer 84 of this embodiment are carried forward from spinal immobilizer 14, such as the use of elongate stiffener members 88, and securely affixed handle members 101. Likewise, the chest members 102 and 104 of this new embodiment correspond to chest members 32 and 34 of the embodiment of FIGS. 1, 1A and 4; abdomen members 106 and 108 correspond to abdomen members 36 and 38 of the earlier embodiment; and diagonal straps 112, 11 4 and diagonal straps 116, 118 respectively correspond to diagonal straps 42, 44 and 46, 48 of the earlier embodiment. It will be noted that all of these new reference numerals are 70 numbers larger than the corresponding numbers that were utilized in the original series.

It will be recalled that collar member 22 was utilized in the embodiment of our invention shown in FIGS. 1 through 4 and 6, in order to secure the novel spinal immobilizer 14 to the backboard 12. It will be noted in FIGS. 8A and 9, however, that no member corresponding to collar member 22 is utilized in this embodiment of our spinal immobilizer, but rather we use the aforementioned elongate straps 130 and 132 extending through the handholes 85 of the backboard, as well as through the handles 101 of the spinal immobilizer. These elongate straps are of sufficient length as to extend circumferentially around the backboard as well as the injured infant, in order that he or she can be secured tightly to the adult size backboard.

As is obvious, the elongate straps 130 and 132 are usually entirely removed from the adult size backboard when the injured child has reached the appropriate medical facility.

In FIG. 8A as well as FIG. 8B, we reveal a novel shoulder pad or spacer means 92 that preferably has a tapered edge 93 so that the pad 92 can be comfortably placed under the shoulders of an infant residing upon our spinal immobilizer 84. This shoulder pad i s preferably utilized in view of the fact that up until approximately eight years of age, a child's head is proportionately rather large for its body. Therefore, if no shoulder pad or spacer means were used, flexion of the head forward would likely occur when the child was placed on a flat surface. This forward flexion may well bring about improper spinal alignment, which may in turn bring about paralysis in the event a certain amount of spinal damage had occurred during the injury the child had sustained. Further justification for the use of the shoulder pad or spacer means 92 involves the fact that the pad makes unlikely an impairment of the airway of the child due to his or her chin being forced against his or her chest.

It is therefore important that appropriate compensation be made for the child's head being proportionately rather large for his or her body, which is adequately taken care of by the shoulder pad or shoulder supplement 92 that the emergency medical personnel can place at a suitable location on the spinal immobilizer 84. As revealed in FIGS. 8A and 8B, this pad is typically placed slightly further away from the head end of the spinal immobilizer than the attachment points for the diagonal straps 112 and 116.

We may utilize Velcro or other suitable attachment means on the underside of the shoulder pad or spacer means 92, in order to secure it to the upper surface of the spinal immobilizer 84. This of course would entail one type of Velcro utilized on the under surface of the pad 92, and Velcro of the opposite type on the upper surface of the spinal immobilizer, but frequently such use of Velcro is not necessary. This latter is true because the placement of the child's weight upon the pad 92 usually serves to satisfactorily anchor it against undesired displacement.

Figure 9:
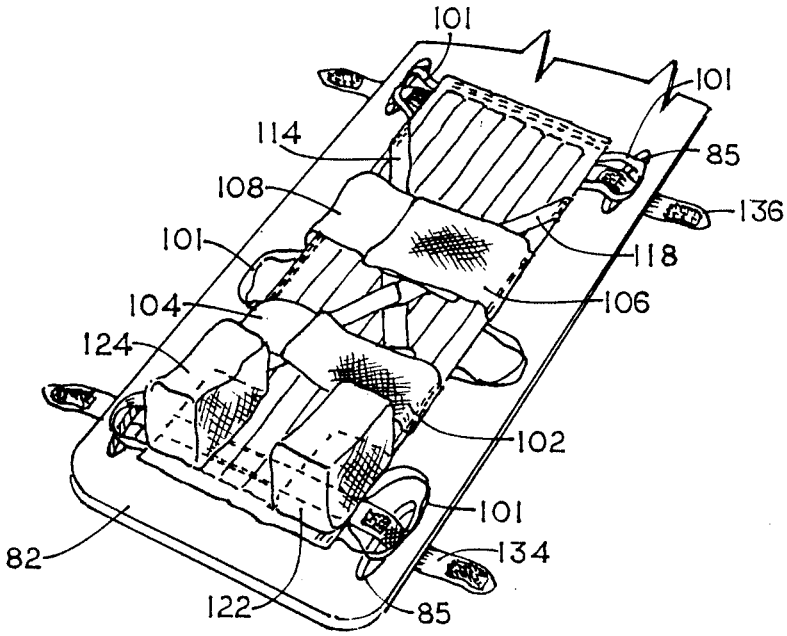
FIG. 9 is a perspective view revealing in more detail, the use of relatively short straps that, by being affixed around the handholes of an adult size backboard, can be used to removably secure our infant immobilizer to the adult size backboard.

In FIG. 9 we reveal an embodiment in which the use of relatively short straps 134 and 136 is depicted, these short straps being utilized in lieu of the elongate straps 130 and 132. The relatively short straps each extend through the respective handle member 101 of the infant immobilizer, and each have Velcro of one type near each end of the strap, on what may be regarded as the upper side of each strap. Velcro of the opposite type is utilized on the upper side of the strap a few inches away, thus making it possible to fasten each end of each short strap to itself directly at the handhole location, thus firmly affixing the spinal immobilizer to the backboard 82.

It is preferable to have the relatively short straps 134 and 136 provided with Velcro in the middle of the upper side of each strap, and Velcro of the opposite type secured on the adjacent portion of the underside of the spinal immobilizer 84. In this way, prevention of loss or displacement of the short straps 134 and 136 is assured. As an alternative, we may sew or otherwise tightly secure the middle potions of the relatively short straps to the underside of the spinal immobilizer.

As is obvious, the straps 134 and 136 are usually entirely removed from the adult size backboard when the injured child has reached the appropriate medical facility. It is therefore obvious that no aspect of our invention serves to unfavorably impact the further use of the adult size backboard with injured adults.

It is thus to be seen that we have provided a highly effective infant immobilizer readily usable by emergency medical personnel, that is characterized by its small size, minimal expense, and its making unnecessary the carrying of an infant size backboard in emergency medical vehicles. The configuration of our infant immobilizer readily lends itself to the extensive use of components impervious to moisture and to blood, meaning that our immobilizer can be readily sanitized after use with one injured infant, and shortly thereafter returned to use with the next injured infant.

We claim:

1. A restraint system for enabling an injured infant or small child to be immobilized on an adult size backboard, adjacent one end of which, a first mating attachment means has been secured, said system comprising a spinal immobilizer to be placed against the spinal portion of the injured infant, and held tightly in place by securing means passing around the chest and abdominal portions of the injured infant, said spinal immobilizer offering considerable resistance to bending about its longitudinal axis by virtue of its use of at least one stiffener member, but permitting a degree of wrap around the torso of the injured infant, a distinct collar member affixed to an upper part of said spinal immobilizer, a front side of which collar member is able to be contacted by the rear portions of the head and neck of the injured infant, and the rear side of which collar member is covered to a substantial extent by a second mating attachment means, such that said collar member can be tightly yet removably attached to said first mating attachment means, said collar member being utilized in combination with a pair of head restraint pads, tightly yet removably attached to the first mating attachment means, to prevent undesired head movement of the injured infant.

2. The restraint system for enabling an injured infant or small child to be immobilized on an adult size backboard as recited in claim 1 in which said attachment means involves the use of a first mating attachment means utilized on an upper surface of said adult size backboard, and a second mating attachment means utilized on the rear side of said spinal immobilizer.

3. The restraint system for enabling an injured infant or small child to be immobilized on an adult size backboard as recited in claim 1 in which said means for removably securing said spinal immobilizer to an adult size backboard involve the use of a first mating means utilized on an upper surface of an intermediate member removably mounted on said adult size backboard, and a second mating attachment means utilized on the rear side of said spinal immobilizer.

4. The restraint system for enabling an injured infant or small child to be immobilized on an adult size backboard as recited in claim 1 in which said securing means involves at least one pair of comparatively wide straps having fastening means for fastening said straps together, tightly around the chest and abdomen portions of the injured infant.

5. The restraint system for enabling an injured infant or small child to be immobilized on an adult size backboard as recited in claim 1 in which first and second pairs of diagonal straps are also secured to said spinal immobilizer, the free ends of each of the respective pairs of said diagonal straps being equipped with a first mating attachment means and a second mating attachment means of the opposite types, such that both pairs of said diagonal straps can be fastened tightly around the infant victim to provide additional restraint, with such to be accomplished before said comparatively wide straps are fastened around the infant victim.

6. The restraint system for enabling an injured infant or small child to be immobilized on an adult size backboard as recited in claim 1 in which said securing means involves separate pairs of chest straps and abdomen straps being utilized, and in which a first mating attachment means is used on the free end of one of said chest straps and one of said abdominal straps, with a second mating attachment means being used on the free end of the other one of said chest straps and on the free end of the other one of said abdominal straps, whereby such straps can be quickly fastened tightly about the chest and abdomen of the infant or child.

7. The restraint system for enabling an injured infant or small child to be immobilized on an adult size backboard as recited in claim 1 in which said attachment means on the rear side of said collar member is a first mating attachment means, with a second mating attachment means being secured near one end of said adult size backboard, such that said spinal immobilizer may be tightly yet removably secured to said backboard.

8. The restraint system for enabling an injured infant or small child to be immobilized on an adult size backboard as recited in claim 1 in which a first mating attachment means is secured to the rear side of said collar, and an intermediate member of flat configuration having a first mating attachment means and a second mating attachment means as the fastening means utilized on both of its principal sides, with a second mating attachment means secured on the side of said flat intermediate member away from said adult size backboard, such that said spinal immobilizer may be directly secured to said intermediate member, and said intermediate member tightly yet removably secured to said backboard.

9. The restraint system for enabling an injured infant or small child to be immobilized on an adult size backboard as recited in claim 1 in which an intermediate member of flat configuration is utilized, said intermediate member containing stiffener means and having fastening means on both of its principal sides, such that said intermediate member can be attached to an adult size backboard, and then receive said attachment means of said collar member, thereby forming a securing means serving to effectively attach said spinal immobilizer tightly yet removably to said adult size backboard.

10. A restraint system for enabling an injured infant or small child to be immobilized on an adult size backboard, comprising a spinal immobilizer to be placed against the spinal portion of the injured infant, and held tightly in place by securing means passing around the chest and abdominal portions of the injured infant, said securing means involving at least one pair of straps located in the vicinity of chest and abdominal portions of the infant, fastening means being located on the free end of each of said straps, such that said straps can be fastened together, tightly around the chest and abdomen portions of the injured infant, said spinal immobilizer being constituted by front and rear sheet-like layers of flexible, relatively impervious material, between which is secured at least one stiffener member, said spinal immobilizer permitting a degree of wrap around the torso of the injured infant, but with very little longitudinal bending of said stiffener member being permitted, a distinct collar member affixed to an upper part of said spinal immobilizer, a front side of which collar member being able to be contacted by the rear portions of the head and neck of the injured infant, and the rear side of which collar member being covered to a substantial extent by attachment means, such that said collar member can be tightly yet removably attached to an adult size backboard.

11. The restraint system for enabling an injured infant or small child to be immobilized on an adult size backboard as recited in claim 10 in which a first mating attachment means is used on the free end of one of said straps, with a second attachment means being used on the free end of the other one of said straps, whereby such straps can be quickly fastened tightly about the injured infant or child.

12. The restraint system for enabling an injured infant or small child to be immobilized on an adult size backboard as recited in claim 10 in which the fastening means on the rear side of said collar member is a first mating attachment means, with a second mating attachment means being secured near the head end of said adult size backboard, such that said spinal immobilizer may be rapidly yet releasably secured to said backboard.

13. The restraint system for enabling an injured infant or small child to be immobilized on an adult size backboard as recited in claim 10 in which first and second pairs of diagonal straps are also secured to said spinal immobilizer, the free ends of each of the respective pairs of said diagonal straps being equipped with a first mating attachment means and a second mating attachment means such that both pairs of said diagonal straps can be fastened tightly around the infant victim to provide additional restraint, with such to be accomplished before the first mentioned straps are fastened around the infant victim.

14. A restraint system for enabling an injured infant or small child to be immobilized on an adult size backboard, comprising a spinal immobilizer to be placed against the spinal portion of the injured infant, and held tightly in place by securing means passing around the chest and abdominal portions of the injured infant, said spinal immobilizer being radiotransparent and being constituted by front and rear sheet-like layers of flexible material, between which are secured a plurality of elongate stiffener members, said spinal immobilizer permitting a degree of wrap around the torso of the injured infant, but with very little longitudinal bending of said stiffener members being permitted, a distinct collar member affixed to an upper part of said spinal immobilizer, a front side of which collar member is able to be contacted by the rear portions of the head and neck of the injured infant, and the rear side of which collar member is covered to a substantial extent by attachment means, such that said collar member can be rapidly and tightly attached to an adult size backboard, said securing means involving a pair of chest straps and a pair of abdominal straps, fastening means being located on the free end of each chest strap, such that said pair of chest straps can be fastened together, tightly around the chest portion of the injured infant, fastening means likewise being located on the free end of each abdominal strap, such that the pair of abdominal straps can be fastened together tightly around the abdominal portion of the injured infant, an intermediate member of flat configuration, having fastening means on both of its principal sides, such that said intermediate member can be attached adjacent the head end of an adult size backboard, and then receive said attachment means of said collar member, thereby forming a securing means serving to effectively attach said spinal immobilizer rapidly yet releasably to the adult size backboard.

15. The restraint system for enabling an injured infant or small child to be immobilized on an adult size backboard as defined in claim 14 in which said fastening means involves the use of a first mating attachment means on the free end of one of said chest straps and one of said abdominal straps, with a second mating attachment means being used on the free end of the other one of said chest straps and on the free end of the other one of said abdominal straps, whereby such straps can be fastened tightly about the injured infant or child.

16. The restraint system for enabling an injured infant or small child to be immobilized on an adult size backboard as defined in claim 14 in which a first mating attachment means is secured to the rear side of said distinct collar member, and a second mating attachment means is secured on the side of said flat intermediate member away from said adult size backboard, such that said spinal immobilizer may be rapidly secured to said backboard.

17. The restraint system for enabling an injured infant or small child to be immobilized on an adult size backboard as defined in claim 14 in which said flat intermediate member possesses sufficient width to accommodate thereon the head of the injured infant as well as a pair of head restraint pads equipped with an attachment means, with said pads to be secured by the use of an attachment means in positions closely adjacent each side of the head of the patient, thus to effectively restrain the head against lateral movement.

18. The restraint system for enabling an injured infant or small child to be immobilized on an adult size backboard as defined in claim 14 in which a pair of comparatively narrow restraint straps are utilized in conjunction with said head restraint pads, to further aid in immobilizing the head of the injured infant.

19. The restraint system for enabling an injured infant or small child to be immobilized on an adult size backboard as defined in claim 14 in which first and second pairs of diagonal straps are also secured to said spinal immobilizer, the free ends of each of the respective pairs of said diagonal straps being equipped with a first mating attachment means and a second mating attachment means such that both pairs of said diagonal straps can be fastened around the infant victim to provide additional restraint, before said chest straps and said abdominal straps are fastened around the infant victim.

20. The restraint system for enabling an injured infant or small child to be immobilized on an adult size backboard as defined in claim 14 in which a shoulder pad is utilized on the upper surface of said immobilizer in the general vicinity of said chest straps, said shoulder pad to be placed under the upper thoracic region of the patient.

21. A restraint system for enabling an injured infant or small child to be immobilized on an adult size backboard, comprising a spinal immobilizer to be placed against the spinal portion of the injured infant, and held tightly in place by securing means passing around the chest and abdominal portions of the injure d infant, said spinal immobilizer being radiotransparent and being constituted by front and rear sheet-like layers of flexible material, between which are secured a plurality of elongate stiffener members, said spinal immobilizer permitting a degree of wrap around the torso of the injured infant, but with very little bending of said stiffener members being permitted, a collar member affixed to the uppermost part of said spinal immobilizer, a front side of which collar member is able to be contacted by the rear portions of the head and neck of the injured infant, and the rear side of which collar member is covered to a substantial extent by a first mating attachment means, such that said collar member can be rapidly and tightly, fastened to an adult size backboard having a second mating attachment means of the other type thereon, said securing means involving a pair of chest straps, a pair of abdominal straps, and two pair of diagonal straps, one member of said chest straps being affixed to a first upper side of said spinal immobilizer, and the other member of said chest straps being affixed to the opposite upper side of said spinal immobilizer, with fastening means located on the free end of each chest strap, such that said pair of chest straps can be fastened tightly around the chest portion of the injured infant, one member of said abdominal straps being affixed to a first middle portion of said spinal immobilizer, and the other member of said abdominal straps being affixed to the opposite middle portion of said spinal immobilizer, with fastening means located on the free end of each abdominal strap, such that the pair of abdominal straps can be fastened tightly around the abdominal portion of the injured infant, fastening means being provided on the free end of each of said diagonal straps, so that said diagonal straps can be fastened tightly around the injured infant before said chest straps and said abdominal straps are fastened around the infant, an intermediate member of essentially flat configuration usable between said backboard and said spinal immobilizer, said intermediate member having a first mating attachment means and a second attachment means on both of its principal sides, with one of said principal sides having hook type attachment means, such that it may be rapidly and tightly fastened to loop type attachment means attached adjacent one end of an adult size backboard.

22. The restraint system for enabling an injured infant or small child to be immobilized on an adult size backboard as defined in claim 21 in which said flat intermediate member possesses sufficient width to accommodate thereon the head of the injured infant as well as a pair of head restraint pads equipped with a first mating attachment means and a second mating attachment means with one pad to be secured by the use of a first mating attachment means and a second mating attachment means to each side of the head of the patient, said head restraint pads serving to effectively immobilize the head of said infant or child against lateral movement.

23. The restraint system for enabling an injured infant or small child to be immobilized on an adult size backboard as defined in claim 21 in which a pair of comparatively narrow restraint straps are utilized in conjunction with said head restraint pads, to aid in immobilizing the head of the injured infant or child against lateral movement.

* * * * *